United States Patent [19]

Daloisio

[11] 4,398,653

[45] Aug. 16, 1983

[54] PORTABLE STORAGE AND DISPENSER PLASTIC HOPPER WITH PLASTIC BASE

[75] Inventor: Pasquale C. Daloisio, New Hope, Pa.

[73] Assignee: Pennsylvania Pacific Corporation, Warminster, Pa.

[21] Appl. No.: 352,174

[22] Filed: Feb. 25, 1982

[51] Int. Cl.[3] ..... B67D 5/06

[52] U.S. Cl. ..... 222/185; 222/143; 206/512; 248/146; 108/53.1

[58] Field of Search ..... 222/130, 131, 143, 185, 222/325; 206/386, 509, 511, 512, 513; 248/146, 176; 108/55.1, 55.3

[56] References Cited

U.S. PATENT DOCUMENTS

| | | | |
|---|---|---|---|
| 3,318,473 | 5/1967 | Jones et al. | 222/185 X |
| 3,729,121 | 4/1973 | Cannon | 222/185 |
| 3,785,534 | 1/1974 | Smith | 222/143 |
| 4,173,295 | 11/1979 | Steinman | 222/185 X |
| 4,213,532 | 7/1980 | Eggert et al. | 206/512 X |
| 4,293,082 | 10/1981 | Matsueda | 222/131 |

*Primary Examiner*—H. Grant Skaggs
*Assistant Examiner*—Michael S. Huppert
*Attorney, Agent, or Firm*—John F. A. Earley

[57] ABSTRACT

A light weight heavy duty, inexpensive and portable stackable assembly for storing and dispensing flowable materials such as capsules and other drug products includes a plastic hopper bin and a plastic base, the surfaces of both hopper and base being smooth, having minimal tendency for the adherence of bacteria, and being easily cleaned. The base construction provides a relatively large area of support for the hopper thus eliminating or minimizing any tendency for the hopper walls to sag and to cause unevenness in the hopper inner surface that could interfere with the flow of the flowable materials out the discharge outlet of the hopper. The assembly is characterized that when stacked the weight of the stack is carried by the base, each of the hoppers being required to support the weight only of its own contents.

3 Claims, 6 Drawing Figures

PORTABLE STORAGE AND DISPENSER PLASTIC HOPPER WITH PLASTIC BASE

BACKGROUND OF THE INVENTION

1. Field of the Invention

The present invention relates to stackable gravity discharge portable hopper bins for handling, storing and dispensing bulk materials in sanitation-conscious or hygienic environments, for example, dry flowables such as capsules and tablets in the drug industry.

2. Description of the Prior Art

A problem with portable hopper bins of the prior art for use in sanitation-conscious environments has been the need to use in their construction materials such as stainless steel that not only are expensive but are heavy, and hence, difficult to move around without the use of a metal caster stand or base. Stainless steel has been employed because the smooth surface thereof is not conducive to the attachment of bacteria, and additionally, such surface is easy to clean.

The problem has been further compounded by the need to provide a supporting stainless steel base or stand upon which to mount the hopper bin. The stand not only adds to the weight and expense but renders the assembly unsuitable for stacking.

A partial solution to these problems is provided by the prior art MH-36 Hopper manufactured and sold by Plastech, a division of Pennsylvania Pacific Corporation, Box C-70, Warminster, PA 18974, the assignee of the present invention. The MH-36 HOPPER is molded of FDA-approved polyethylene, closed and open bottom versions being provided. It is an alternative to stainless steel hoppers for handling liquids and dry flowables, the structure comprising a seamless one-piece molding that simplifies cleaning. This HOPPER, although light in weight and relatively inexpensive, is supplied with a heavy and expensive removable plated metal caster base or stand for easy mobility that renders the assembled hopper and base unsuitable for stacking.

There thus exists a need or demand for a lightweight, heavy duty, inexpensive assembly comprising a hopper bin and supporting base or stand which, as an assembly, is stackable and the surfaces of which are smooth, have minimal tendency for the adherence of bacteria, and are easily cleaned.

SUMMARY OF THE INVENTION

An object of the invention is to provide a lightweight portable storage and dispenser hopper with a plastic base.

Another object of the invention is to provide such a hopper and base that are stackable as an assembly.

A further object of the invention is to provide such a stackable assembly wherein each hopper carries its own load only and the load of the stack is carried by the base components.

Still another object of the invention is to provide such a stackable assembly that may be lifted by a pallet jack or forklift truck.

An additional object of the invention is to provide such stackable hopper assembly that allows four-way forklift truck entry.

A further object of the invention is to provide for use with a hopper a plastic base having a double wall seamless smooth frame that is easy to clean.

Still another object is to provide such a plastic base that provides a relatively large area of support for the hopper thereby to avoid sag in the hopper wall and resultant tendency to unevenness of the inner hopper surface that tends to interfere with free flow.

In accomplishing these and other objectives of the present invention there is provided a plastic hopper molded as a seamless single wall. There is also provided a plastic supporting base for the hopper that is molded as a seamless double wall. Both the hopper and the base preferably are molded of FDA-approved polyethylene. The hopper fits within the base in a hand-in-glove arrangement, being embraced therein and resting thereon in contact with a relatively large supporting upper surface area of the base. The external configuration of the base and the upper portion of the hopper is generally rectangular, the base having a leg at each corner and a post at each corner which extends upwardly to the upper surface of the hopper, each post fitting into a notch that is provided at each of the corners of the hopper. The hopper is open at the top and at the bottom, a lid being provided for closing the top and an iris flow valve being provided at the bottom. The shape of the wall of the hopper gradually changes from a rectangular outline at its extreme upper portion to that of a frustum of a cone, the shape of the opening at the bottom being circular. The rate of flow of the flowable material out of the bottom opening under the force of gravity, is controlled by adjusting the size of the opening of the iris flow valve.

Other objects and advantages of the present invention will become apparent from the following description of the preferred embodiment as illustrated in the accompanying drawings.

DESCRIPTION OF THE PREFERRED EMBODIMENT

Figure 1:
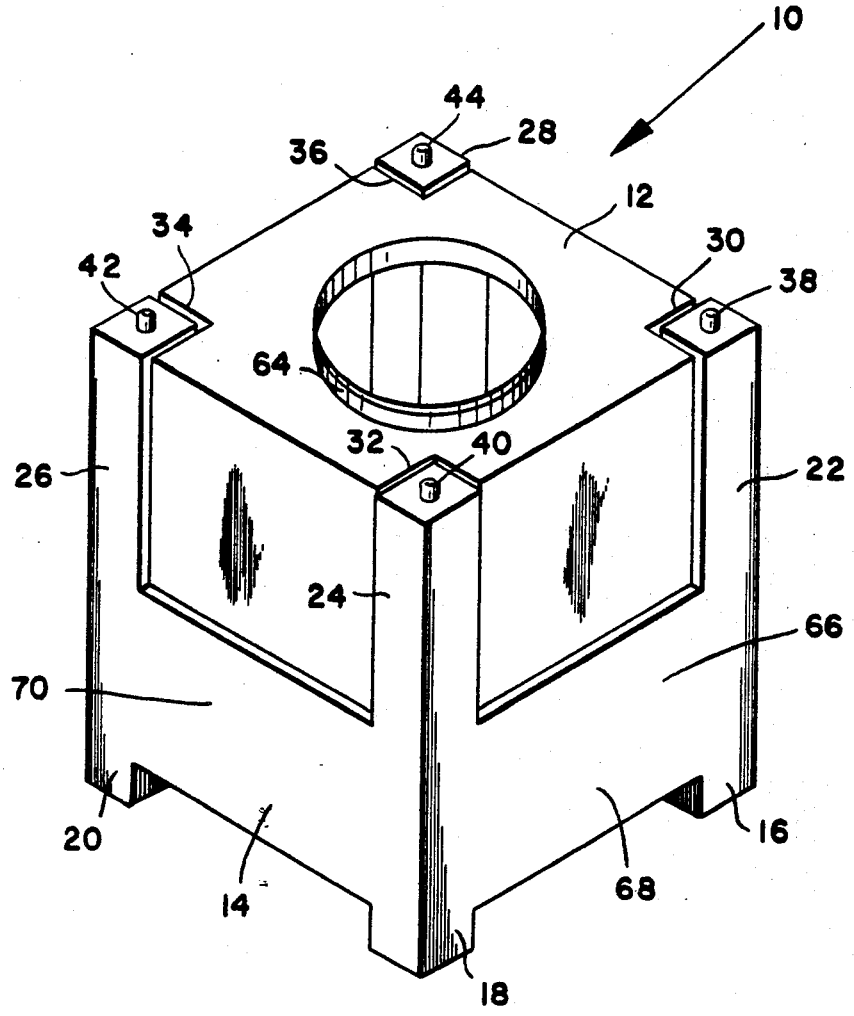
FIG. 1 is a perspective view of the assembled hopper and base unit, with the lid removed, according to the invention.

Turning now to the drawings that have been selected for illustrating the invention, there is shown in FIG. 1 an assembled unit of rectangular configuration generally indicated at 10 and comprising a hopper 12 mounted in a base or stand 14. The hopper 12 and base 14 are both made of FDA-approved polyethylene by a rotational molding method as described in U.S. Pat. No. 4,280,640, hopper 12 being molded as a seamless single wall two tenths of an inch (0.2"; 0.51 cm.) thick and base 14 being molded as a seamless double wall one quarter inch (0.25"; 0.61 cm.) thick.

Figure 3:
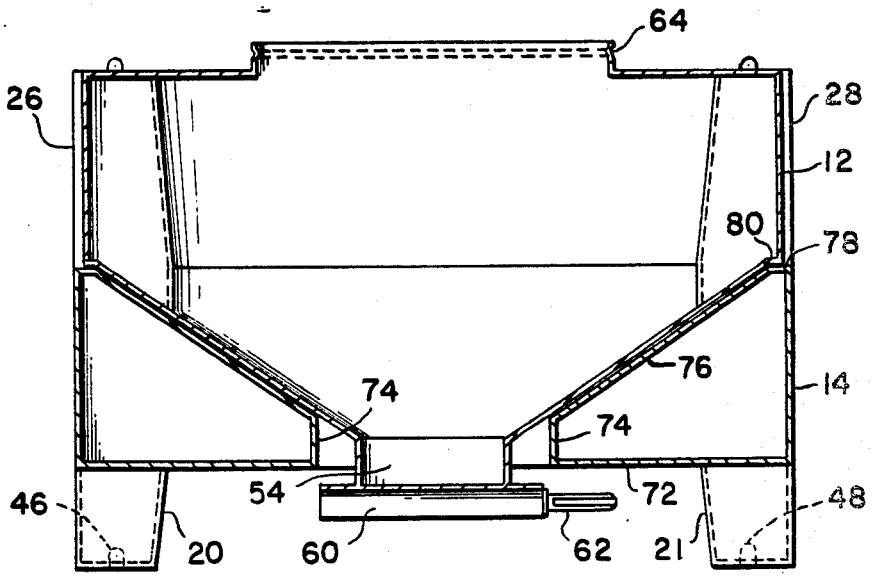
FIG. 3 is a cross-sectional view of the assembled unit, without the lever lock lid, taken along the lines 3—3 in FIG. 2.

Formed integrally with base 14 are four legs of which only three, legs 16, 18 and 20 are shown in FIG. 1, the fourth leg in FIG. 1 being out of sight on the far side of unit 10. The fourth leg, designated 21, is seen in FIG. 3. The legs on base 14 are long enough to allow the entry of the times of a forklift truck for lifting the assembled and loaded unit 10. Four-way forklift truck entry, that is entry from either of the four sides of unit 10 is permitted.

Also formed integrally with base 14 are four posts as indicated at 22, 24, 26 and 28 each of which extends upwardly from the upper body of base 14 to the upper surface of hopper 12. As shown in FIG. 1, each of the posts 22, 24, 26 and 28 fits into an associated notch that is provided at each of the corners of the hopper 12, post 22 fitting into a notch 30, post 24 into a notch 32, post 26 into a notch 34 and post 28 into a notch 36.

For facilitating stacking of the assembled units 10 and for holding the units 10 in place when stacked, there is provided at the top of each of the posts 22, 24, 26 and 28 a knob or pin that is adapted to fit into an associated cup or recess that is provided at the bottom of each of the four legs of the base unit 14 of the immediately upper unit 10 of the stack. Each knob is integrally formed in the associated post. Similarly, the cups are integrally formed in the bottoms of the associated legs.

Figure 2:
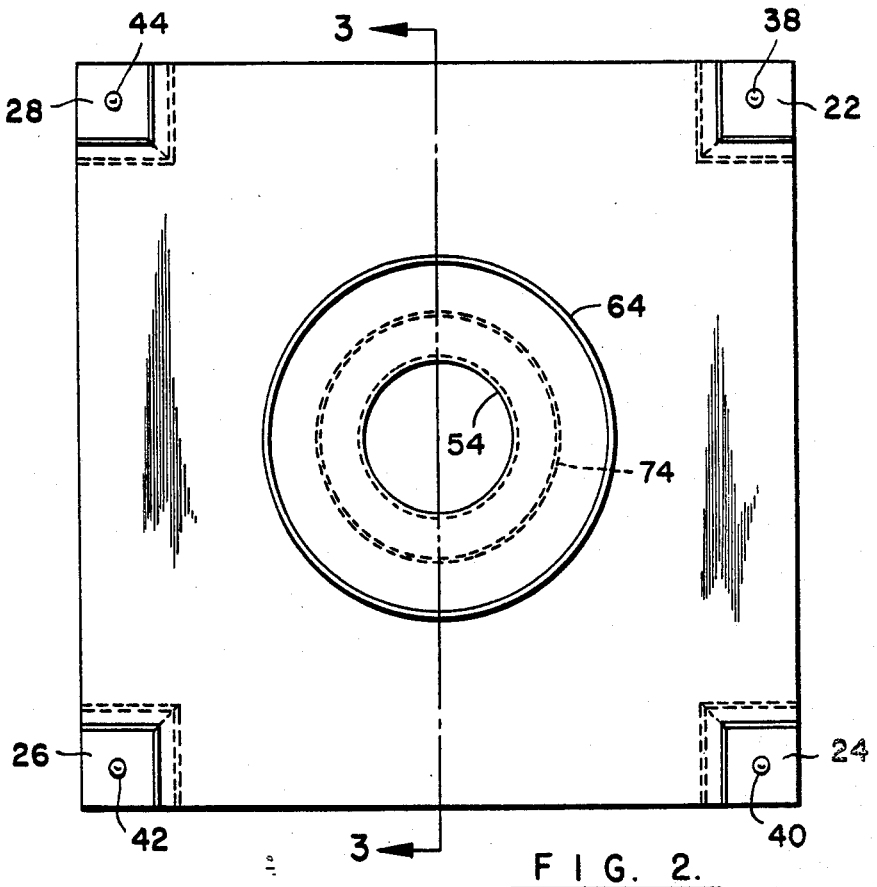
FIG. 2 is a top view of the assembled unit (valve not shown)

Specifically, as seen in FIGS. 1 and 2, there is provided at the top of post 22 a knob 38, at the top of post 24 a knob 40, at the top of post 26 a knob 42, and at the top of post 28 a knob 44; and as indicated in dotted outline in FIG. 3, there is provided a cup 46 at the bottom of leg 20, and a cup 48 at the bottom of leg 21, a similar cup being provided at the bottom of each of the other legs 16 and 18.

A feature of the assembled unit 10 according to the invention is that with units 10 stacked one upon another and held in place by cups 46, 48, etc. at the bottom of the legs of an upper unit 10 fitting over associated knobs 42, 44, etc. of the posts of an immediately lower unit 10, the entire weight of the upper units 10 is carried by the posts and the legs. That is to say, none of the weight of an upper unit 10 is placed upon the hopper 12 of a lower unit 10. Accordingly, each of the hoppers 12 in the stack is required to support only the weight of the load or contents therein. The weight of the stack is carried by the base components namely the posts 22, 24, 26 and 28 and the associated legs 16, 18, 20 and 21.

Figure 4:
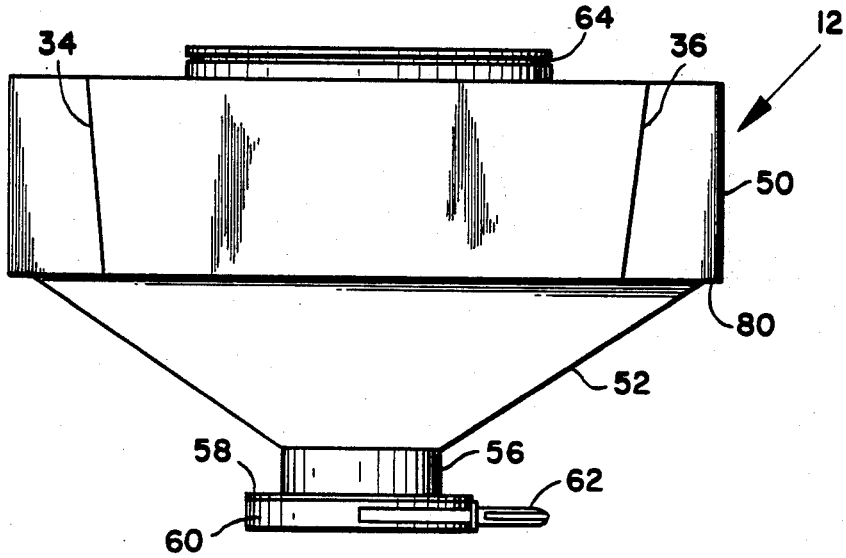
FIG. 4 is a side elevational view of the hopper.
Figure 5:
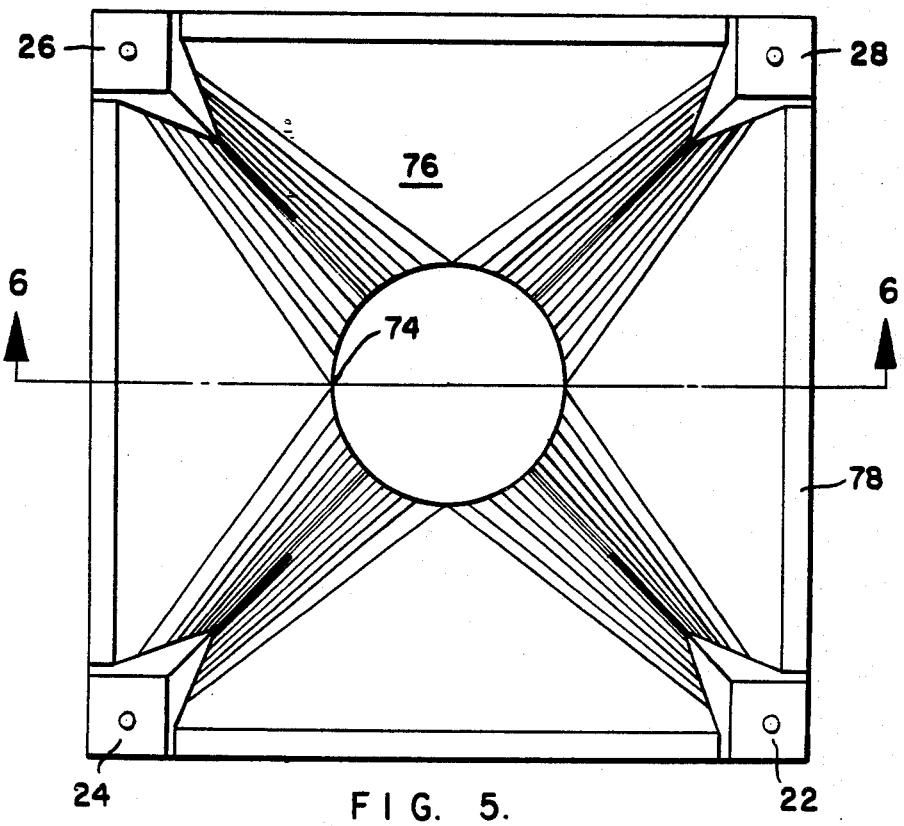
FIG. 5 is a top view of the base.

By reference to FIGS. 2, 3 and 4, it is seen that the hopper 12, in a top view thereof is generally rectangular in outline having the aforementioned notches 30, 32, 34 and 36 cut in the corners thereof. In side elevation facing in the direction of the arrows 3—3 in FIG. 2, the outline of the upper portion 50 thereof, as seen in FIG. 4 is rectangular, the notches 30, 32, 34 and 36 being cut in the four corners of the portion 50. The lower portion indicated at 52 in FIG. 4 is generally frustoconical in shape, gradually sloping downwardly from a rectangular configuration of the portion 50 to a conical or bowl shape until, at an extreme lower portion or outlet 54 of the hopper 12, the shape is that of a cylinder indicated at 56.

At the bottom of cylindrical section 56, there is provided a flange 58 for facilitating the attachment to the outlet 54 of an iris-type flow valve indicated at 60. Valve 60 has a control handle 62 for adjusting the size of the outlet 54 of hopper 12, and hence, the rate of flow of the contents therefrom. One form of iris-type control valve that may be utilized for the valve 60 is the Model No. FV8A Syntron Flow Control Valve made under U.S. Pat. No. 2,961,213 by FMC Corporation.

A lever lock and ring for a lid (not shown) for hopper 12 may be provided as indicated at 64 in FIGS. 1–4.

At best seen in FIG. 1, the base 14 is made in the form of an integral, seamless double wall includes an outer shell 66 including a front wall and a rear wall connected by a pair of sidewalls, only the front wall 68 and one of the sidewalls, 70, being shown. The rear wall and the other sidewall are out of sight in the perspective view of FIG. 1, but it will be understood that the rear wall is identical in construction to the front wall 68 and the sidewall (not shown) is identical in construction to the sidewall 70. Leg 16 and post 22 are formed integrally with the front wall 68 and the sidewall opposite sidewall 70, and leg 18 and post 24 are formed integrally with the front wall 68 and the sidewall 70. Similarly, legs 20 and 21 and posts 26 and 28 are formed integrally with their associated rear and sidewalls.

Figure 6:
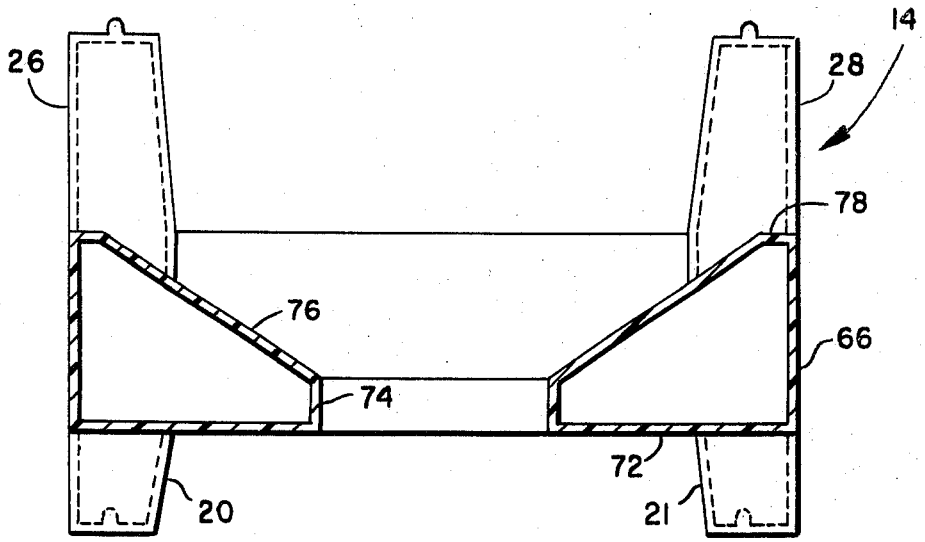
FIG. 6 is a cross-sectional view of the base without the hopper, taken along the lines 6—6 of FIG. 5.

Bottom panels 72, as seen in FIGS. 3 and 6, connect the bottoms of all of the walls of the outer shell 66 to a cylindrical inner wall 74 that, in turn, is connected to the bottom of an inner shell 76. The tops of all of the walls of the outer shell 66 are connected by top panels 78 to the top of the inner shell 76. The inner shell 76, similarly to the lower portion 52 of the hopper 12, is generally frustoconical in shape, gradually sloping downwardly from a rectangular configuration at the top of shell 76 to a conical or bowl shape at the bottom.

The top panels 78 and the inner shell 76 are smooth and shaped to conform to the configuration of the lower portion 52 of the hopper 12. Additionally, a shoulder 80 that is provided on hopper 12 rests on the top panels 78. With this arrangement, the base 14 provides firm and close support for the hopper 12 over a relatively large area of the hopper 12. As a result, any tendency for the walls of the hopper to sag under load is eliminated or substantially minimized. This avoids unevenness of the hopper inner surface that could tend to interfere with the free flow of the contents out of the discharge outlet 54 of the hopper 12, making unnecessary the use of a vibrator for maintaining a continuous flow at the outlet of content.

Thus there has been provided according to the invention a light weight, heavy duty, inexpensive and portable assembly comprising a plastic hopper 12 and a supporting plastic base or stand 14 for dispensing flowable materials such as capsules going to a printing machine for having a brand name placed thereon. The assembly is stackable and the surfaces are smooth, and hence have minimal tendency for the adherence of bacteria, and are easily cleaned. The assembly is further characterized in the relatively large area of firm support that the base 14 provides for the hopper 12 whereby any tendency for the walls of the hopper 12 to sag and become uneven is eliminated or minimized, thus avoiding unevenness of the hopper inner surface that could interfere with the flow of the flowable contents out of the discharge outlet of the hopper. The assembly is characterized, additionally, in that when stacked the weight of the stack is carried by the base components, each of the stacked hoppers being required to support only its own individual load.

I claim:

1. An assembly for storing and dispensing flowable materials such as capsules, tablets, pills and other dry products comprising, a hopper having a generally rectangular upper portion and a generally frustoconical lower portion with external peripheral shoulder means at the interface of said upper and lower portions, said hopper being molded of plastic as a seamless single wall with vertical notch means provided at each of the four corners of said upper portion, and a base molded of plastic as a seamless double wall having an outer wall that is generally rectangular in shape and an inner wall that is generally frustoconical in shape and matching the frustoconical shape of said lower portion of said hopper, said base outer and inner walls being connected by bottom panel means and top panel means, said base having leg means and upstanding post means integrally molded with said inner and outer walls at each of the four corners of said base.

said hopper fitting within said base with said shoulder means of said hopper resting on said top panel means of said base and said frustoconical lower portion of said hopper resting on said frustoconical inner wall of said base with each of said post means at the corners of said ase fitting within an associated notch at the corners of said hopper.

2. An assembly as specified in claim 1 wherein each of said leg means is of sufficient length to allow the entry under said base of the tines of a forklift truck.

3. An assembly as specified in claim 2 wherein a recess is provided at the bottom of each of said leg means and a knob is provided at the top of each of said post means, said post means being of such length that the upper surfaces thereof are approximately co-planar with the upper surface of said hopper when said hopper is supported within said base, whereby upon stacking of one assembly upon another assembly the recess in the bottom of each of said leg means of an upper assembly fits over an associated knob means on the tops of said post means thereby to retain said upper assembly in place.

* * * * *

UNITED STATES PATENT AND TRADEMARK OFFICE

Certificate

Patent No. 4,398,653 Patented August 16, 1983

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Pasquale C. Daloisio and Peter J. Connors.

Signed and Sealed this Twenty-sixth Day of August, 1986.

BRADLEY R. GARRIS,
*Office of the Deputy Assistant Commissioner for Patents.*